United States Patent [19]

Langford

[11] Patent Number: 4,459,705

[45] Date of Patent: Jul. 17, 1984

[54] GARMENT WITH INTERFACING EXTENDED TO FORM LOWER BODY SUIT

[76] Inventor: Joan M. Langford, 1901 Yorkgate Dr., Raleigh, N.C. 27612

[21] Appl. No.: 432,538

[22] Filed: Jan. 19, 1983

[51] Int. Cl.[3] ..... A41B 1/22

[52] U.S. Cl. ..... 2/105; 2/71; 2/78 A; 2/74

[58] Field of Search ..... 2/105, 272, 97, 224, 2/75, 71, 212, 80, 72, 78 A, 78 BC, 70, 73

[56] References Cited

U.S. PATENT DOCUMENTS 1,419,059 6/1922 Klein ..... 2/71

1,691,790 11/1928 Volker ..... 2/71

*Primary Examiner*—Doris L. Troutman

*Attorney, Agent, or Firm*—Mills and Coats

[57] ABSTRACT

The present invention entails a single piece garment having a two piece garment appearance. First, a dress type outer garment section is provided and includes shoulder areas as well as neck and arm openings. A lining or interfacing is secured interiorly of said outer garment section about said shoulder areas by stitching the lining or interfacing about said neck and arm opening. From the area where said lining is secured by stitching to said outer garment section, the lining or interfacing extends downwardly in an unsecured relationship to said outer garment section. This lower extending lining or interfacing is formed into a body suit that encloses a portion of a subject's mid-body area.

3 Claims, 3 Drawing Figures

GARMENT WITH INTERFACING EXTENDED TO FORM LOWER BODY SUIT

FIELD OF INVENTION

The present invention relates to clothing and apparel, and more particularly to children's clothing of the single piece garment type for fitting and enclosing chest, pelvic, and midbody areas of a subject.

BACKGROUND OF INVENTION

It is difficult to dress young children at a reasonable cost in such a manner that they appear neat and tidy. For example, as a young child is lifted by an adult, it is not uncommon for the upper garment worn by the child to separate from the lower garment. Because of this and situations like this, some parents tend to encourage the wearing of a single piece garment. But the real drawback to single piece children's garments is that such garment tends to be less than fashionable or appropriate—many of them giving virtually the same look or appearance.

Therefore, there is a need for a neat and fashionable single piece shoulder to crotch single garment that is relatively inexpensive and practical.

SUMMARY AND OBJECTS OF THE INVENTION

The present invention entails a practical single piece child's shoulder to crotch garment that is easily made and relatively inexpensive. Moreover, the single piece garment of the present invention is fashionable and designed to give the appearance of a two piece garment. In particular, the single piece garment of the present invention includes an outer upper garment section that is generally in the form of a dress. The upper garment section includes a lined or interfacing formed about the shoulder areas thereof and stitched to the upper garment section about neck and arm openings of the upper garment section. From the points of stitching, the lining or interfacing extends downwardly in a nonattached relationship with said upper garment section and is formed into a body type suit enclosing a portion of the subject's mid-body area. For example, the lower extension of the lining or interfacing can be formed into a bloomer type body suit for a girl or a trouser/pant type garment for a boy.

It is, therefore, an object of the present invention to provide a practical and relatively inexpensive child's garment that is of a one piece construction but which appears to be a two piece garment.

A further object of the present invention resides in the provision of a single piece child's garment that is fashionable and appears to be a two piece garment, but which is easy for the child to get into and out of.

Still a further object of the present invention resides in the provision of a child's single piece garment of the character referred to above that is relatively simple in design and which minimizes the sewing time required for a garment of its general type.

It is also an object of the present invention to provide a single piece child's garment of the character referred to above that includes an interfacing or lining that is provided with an integral extension that actually forms a main part of the body enclosing garment.

A further object of the present invention is to provide a single piece child's garment of the character referred to above wherein the lining or interfacing referred to is secured about an uppermost area of the upper garment section and hangs therefrom where a lower portion of the lining or interfacing is formed into an appropriate body encompassing suit.

Another object of the present invention resides in the provision of a single piece body garment of the character referred to above designed such that the same can withstand wear and tear from a child.

Other objects and advantages of the present invention will become apparent from a study of the following description and the accompanying drawings which are merely illustrative of the present invention.

CHILD'S SINGLE PIECE GARMENT

Figure 1:
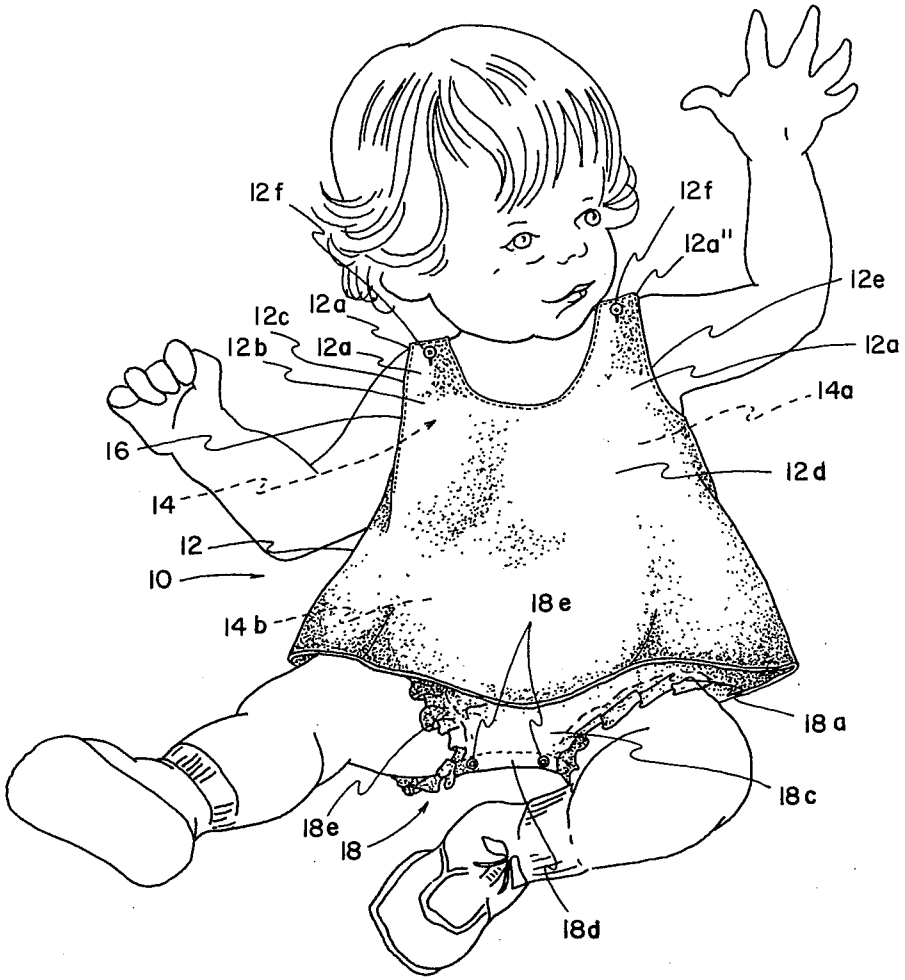
FIG. 1 is a perspective view of a child wearing the garment of the present invention.
Figure 2:
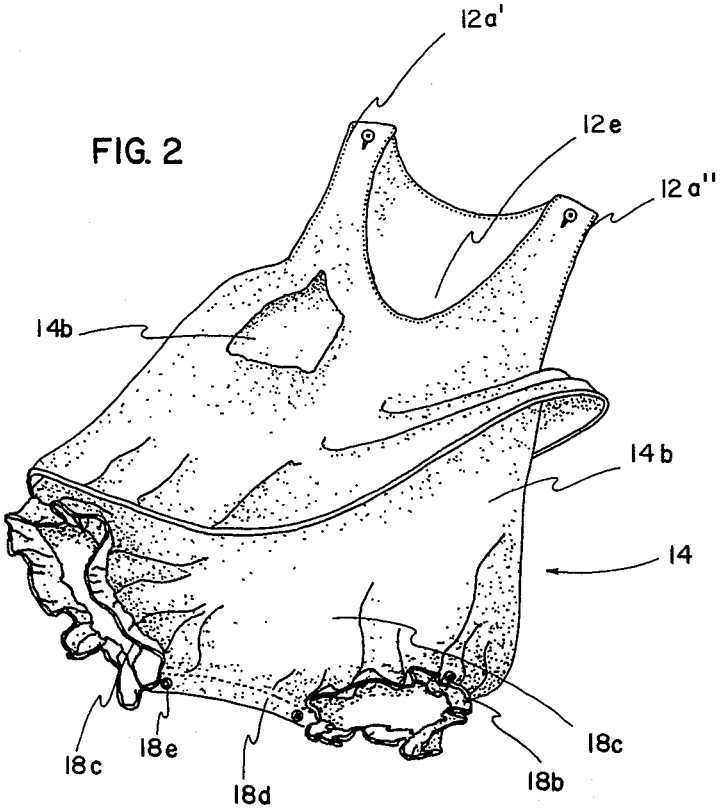
FIG. 2 is a front elevational view of the garment of the present invention with a portion of the upper outer garment broken away to illustrate an underlying lining.
Figure 3:
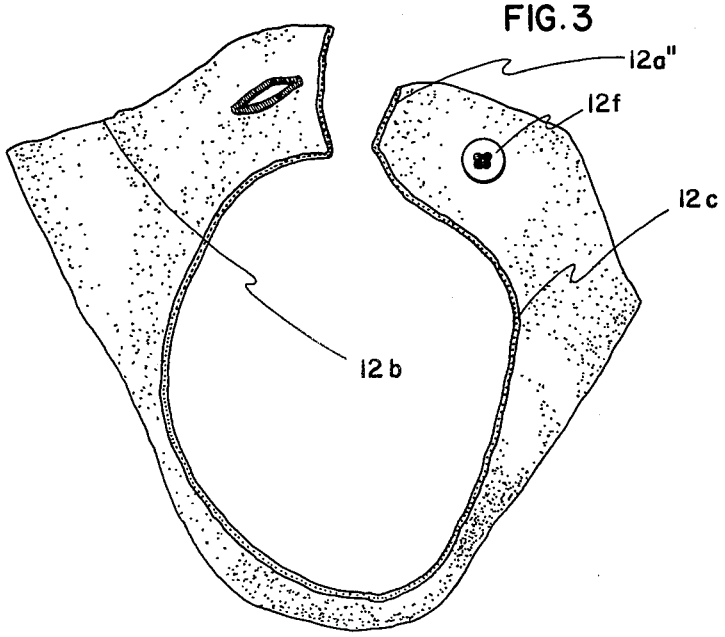
FIG. 3 is a fragmentary view illustrating one set of shoulder straps and associated arm opening of the garment of the present invention.

With further reference to the drawings, a child's single piece garment of the present invention is shown therein and indicated generally by the numeral 10.

Single piece garment 10 includes an upper garment section 12 that is designed in the general form of an "A" - dress. It is appreciated that the basic shape or styling of upper garment section 12 could vary depending upon one's desires.

Viewing garment section 12, it is seen that the same includes shoulder areas **12*a*, a neck opening 12*b*, a pair of arm openings 12*c*. Forming a portion of the shoulder area about each side of said neck opening 12*a*, there is provided two sets of shoulder straps 12*a'* and 12*a''* and each set is secured together through button 12*g*** and an appropriate buttonhole.

Formed below neck opening **12*b* is an upper chest area 12*d* and likewise about the back of upper garment section 12, there is formed an upper back area 12*e*. Extending below upper chest area 12*d* and upper back area 12*e* is a lower area 12*b* that forms a substantial part of the upper garment section 12**.

Secured interiorly of upper garment section 12 is an interfacing or lining 14. In the design disclosed herein, interfacing 14 is secured interiorly of upper garment section 12 by stitch seams referred to by the numeral 16. As indicated in the drawings, interfacing 14 is secured to upper garment section 12 by stitching along neck opening **12*b* and around and along arm openings 12*c*. It is appreciated that the respective shoulder straps 12*a'* and 12*a''* form portions of both said neck opening 12*b* and arm openings 12*c*. In addition the respective shoulder straps of strap sets 12*a'* and 12*a''* include terminal ends that are provided with stitching means or a stitch seam that secures interfacing 14** therealong also.

Consequently, it is appreciated that interfacing or lining 14 is totally supported about the upper shoulder and arm opening area of upper garment section 12. This enables interfacing 14 to essentially hang from upper garment section 12. It is thusly appreciated that interfacing 14 serves and functions to form a lining area **14*a* about the upper portion of the upper garment section 12**.

Interfacing 14 includes a lower integrally formed extension 14*b* that projects downwardly from where the stitching means attaches to upper garment section 12. This integral interfacing extension 14*b* extends beyond the lower terminal edge of upper garment section 12.

Lower interfacing extension 14*b* is formed into a body suit or other type of mid-body enclosings construction indicated generally by the numeral 18. In the case of the present disclosure, the body suit 18 is in the form of a bloomer type pant structure including a pair of elastic leg openings 18*a* and 18*b*. This is particularly illustrated in the accompanying drawings.

A transverse crotch split is provided in order that the entire single piece garment 10 can be easily placed on a child. In this regard, it is seen that the transverse crotch split defines front and back flap sections 18*c* and 18*d* which are secured together by snaps 18*e* or other appropriate fastener means.

It is appreciated that the upper garment section 12 along with the lower interfacing body suit 18 can be of many various designs. In fact the very same principle can be incorporated into a design for a boy. In this regard, the upper garment section would be provided in the form of a shirt or shell type design and the lower body suit portion 18 could be in the form of pants, trousers or even shorts. In this regard, it may be beneficial to provide a split leg and crotch design that enables the lower body suit portion to define two half-sections. Again this would enable a single piece garment 10 to be easily placed on the child.

From the foregoing specification, it is seen that the present invention presents a very neat and fashionable single piece garment for a young child that appears to be a two piece garment. By utilizing the interfacing of the upper garment section and extending that interfacing to form a lower body suit, a very efficient, simple and practical design results. Such a design substantially reduces sewing time and makes very efficient utilization of material. Moreover, the basic design principle disclosed and discussed herein can be extended and used in a wide variety of overall designs.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A single piece garment having the appearance of a two-piece upper and lower garment comprising: an outer upper garment section that includes neck and arm openings, shoulder areas, upper chest and back areas disposed below said shoulder areas, and a lower area extending below said upper chest and back areas; said shoulder areas including a pair of shoulder panels that extends from said upper chest area to said upper back area so as to define said neck opening therebetween and wherein said arm openings are defined and formed in part by said same shoulder panels and wherein each shoulder panel includes a substantial transverse width for covering a substantial portion of an individual's shoulder when the same is worn by that individual, and wherein said shoulder panels of substantial transverse width effectively separates said neck opening from said arm openings; an interfacing lining secured interiorly of said upper garment section and secured directly to said shoulder panels thereof and extending under and across said shoulder panels to form an inner garment lining thereabout; stitch means securing said interfacing lining to said upper garment section at points between said shoulder panels and above the lower area of said upper garment section; said stitch means including stitching that extends completely around said neck opening with said stitching directly attaching said interfacing lining to said outer upper garment section about the neck opening along adjacent portions of said shoulder panels and along adjacent portions of said upper chest and back areas of said outer upper garment section that lie adjacent said neck opening; said stitching means further including stitching that extends around each of said arm openings with said stitching directly attaching said interfacing lining to said outer upper garment section about said arm openings along adjacent portions of said shoulder panels and along adjacent portions of said outer upper garment section; and wherein said interfacing lining is directly attached interiorly of said upper garment section to said shoulder panels and to said neck and arm openings in order to provide a closely attached full inner lining for the upper portion of said outer upper garment and wherein said closely attached full inner lining extends upwardly from at least said arm openings to said shoulder panels and neck openings; said interfacing lining extending below said arm openings in an unattached and hanging fashion with said interfacing being spaced from the lower area of said upper garment section; and wherein said interfacing lining extending below said arm openings forms a bloomer type garment that is itself independent of said outer upper garment section for enclosing a portion of a subjects's mid-body area and including leg openings therein for allowing the legs of the subject to extend therethrough, whereby the interfacing lining of said single piece garment forms an upper closely attached lining for the outer upper garment section and at a point above the lower area of said upper garment section and below said arm openings separates therefrom to form said bloomer type garment about a portion of the subject's mid-body area.

2. The single piece garment of claim 1 wherein said bloomer type garment includes a split transverse crotch area wherein said split transfer crotch area includes first and second separable sections that includes securing means for securing the same together but which are separable.

3. A method of forming and fabricating a single piece garment design that has the appearance of a two piece garment comprising the steps of: forming an outer upper garment and providing the same with a pair of shoulder panels that define a neck opening between said shoulder panels and wherein an arm opening is formed and defined about the outside of each shoulder panel; securing an inner lining to said neck and arm openings of said upper garment section so as to form an upper inner lining about the shoulder panels and the areas around and adjacent said neck and arm openings; said step of securing said inner lining to said neck and arm openings including the step of stitching said inner lining to and completely around said neck and arm openings so as to securely attach said inner lining directly to said outer upper garment about said neck and arm openings; extending said inner lining downwardly from said arm openings of said upper garment section in an unattached fashion and forming a hanging lower lining extension with said hanging lower lining extension extending downwardly passed the lower terminal end of said upper garment section; and forming said lower hanging lining extension into a body suit type garment section for enclosing the mid-body area of a subject where a single piece garment is formed by the integral construction of said upper garment section with said inner lining and the body type suit formed from an extension of said inner lining.

* * * * *